US012232665B2

(12) United States Patent
Zhao et al.

(10) Patent No.: US 12,232,665 B2
(45) Date of Patent: Feb. 25, 2025

(54) POCKET SOAP DISPENSER

(71) Applicant: MMID PRODUCTS B.V., Delft (NL)

(72) Inventors: Jiaji Zhao, Delft (NL); Wilmer Hans Van Kampen, Delft (NL)

(73) Assignee: MMID PRODUCTS B.V., Delft (NL)

( * ) Notice: Subject to any disclaimer, the term of this patent is extended or adjusted under 35 U.S.C. 154(b) by 115 days.

(21) Appl. No.: 16/965,158

(22) PCT Filed: Feb. 4, 2019

(86) PCT No.: PCT/NL2019/050069
§ 371 (c)(1),
(2) Date: Jul. 27, 2020

(87) PCT Pub. No.: WO2019/151863
PCT Pub. Date: Aug. 8, 2019

(65) Prior Publication Data

US 2020/0359849 A1 Nov. 19, 2020

(30) Foreign Application Priority Data

Feb. 2, 2018 (NL) ..... 2020372

(51) Int. Cl.
*A47K 5/09* (2006.01)

(52) U.S. Cl.
CPC ..... *A47K 5/09* (2013.01)

(58) Field of Classification Search
CPC ..... Y10S 241/602; A47K 5/09; A47K 5/10; A47K 5/1211; A47J 43/25; A47J 43/255; B02C 19/20

(Continued)

(56) References Cited

U.S. PATENT DOCUMENTS 823,446 A * 6/1906 Schuster ..... F23K 3/04 241/276
823,572 A 6/1906 Wilson (Continued)

FOREIGN PATENT DOCUMENTS

BE 704349 A 2/1968
CN 202821127 U 3/2013

(Continued)

OTHER PUBLICATIONS

International Search Report dated Jun. 26, 2019 issued in corresponding International Patent Application No. PCT/NL2019/050069 (2 pgs.).

(Continued)

*Primary Examiner* — Charles P. Cheyney
(74) *Attorney, Agent, or Firm* — Pillsbury Winthrop Shaw Pittman, LLP

(57) ABSTRACT

To properly clean one's hands, soap may be used in combination with water. However, soap is not always at hand and therefor one might want to carry around soap in a bag or purse. A soap dispenser is provided which allows a user to scrape scrapings of soap of a piece of soap while holding the dispenser in one hand. With the other hand, part of the dispenser may be rotated which causes the scrapings to be scraped of the piece of soap. This process may be performed before wetting the hands, and thus prevent contact between the piece of soap and water. Furthermore, the dispenser substantially encloses the piece of soap and therewith prevents contact between the soap and water, dirt, and other contaminating factors. The dispenser may be closed during transportation to prevent soap ending up in the bag or purse in which the dispenser is carried around.

17 Claims, 2 Drawing Sheets

(58) Field of Classification Search
USPC ..... 241/59, 602, 93, 169.1, 280; 222/390, 222/548
See application file for complete search history.

(56) References Cited

U.S. PATENT DOCUMENTS 824,154 A 6/1906 Shaver
832,572 A * 10/1906 Wilson ..... F24H 1/205 122/406.1
875,985 A 1/1908 Conery
936,101 A * 10/1909 Edwards, Jr. ..... A47J 42/04 241/169.1
945,495 A 1/1910 Fowler
983,318 A * 2/1911 Shaver ..... A47J 43/25 241/101.5
999,210 A 8/1911 Fowler
999,211 A 9/1911 Fowler
1,037,456 A 9/1912 Fowler
1,157,013 A * 10/1915 Lewis ..... F25C 5/12 83/592
1,421,300 A 6/1922 Parker
1,502,347 A 7/1924 Nelson
1,970,492 A * 8/1934 Crankshaw ..... A47J 43/25 241/274
2,011,129 A 8/1935 Voorhis
2,112,812 A * 3/1938 Kaplan ..... A47K 5/09 241/301
2,519,671 A * 8/1950 Law ..... A47G 19/24 222/545
2,700,995 A * 2/1955 Ritter ..... C11D 13/20 241/278.1
2,751,118 A * 6/1956 Soule ..... A47J 47/01 222/252
2,867,255 A * 1/1959 Berney ..... A47J 43/255 241/273.2
3,464,469 A 9/1969 Belz
3,552,460 A * 1/1971 Cooney ..... A23G 7/0018 241/168
3,581,790 A * 6/1971 Conte ..... A47J 43/255 241/88.1
3,642,045 A * 2/1972 Buvelot ..... A47J 43/25 D7/678
3,869,773 A 3/1975 Gneiding
4,127,375 A * 11/1978 Nelson ..... A47J 43/255 401/175
D260,301 S 8/1981 O'Connor
4,311,283 A * 1/1982 Bounds ..... A47J 42/34 241/168
4,527,764 A 7/1985 Krause
4,588,136 A * 5/1986 Homma ..... F25C 5/043 241/168
4,996,000 A 2/1991 Redeker
5,198,140 A 3/1993 Joshi
5,364,037 A * 11/1994 Bigelow ..... A47J 43/255 241/273.3
RE36,155 E * 3/1999 Scallen ..... B26D 3/22 99/538
5,967,434 A * 10/1999 Virk ..... A47J 43/255 241/281
6,412,717 B1 * 7/2002 Menelaou ..... A47J 43/255 241/273.1
6,520,436 B1 * 2/2003 Herren ..... A47J 43/255 241/285.2
7,204,440 B2 * 4/2007 Fouse ..... A47J 42/34 241/168
7,611,084 B2 * 11/2009 Bisio ..... A47J 43/255 241/89.4
7,648,088 B2 * 1/2010 Eikelenberg ..... A47J 43/255 241/168
8,132,502 B2 * 3/2012 Pai ..... A47J 43/255 99/537
2005/0040265 A1 * 2/2005 Pai ..... H02K 7/116 241/169.1
2022/0009701 A1 * 1/2022 Nagoshi ..... B26D 3/28

FOREIGN PATENT DOCUMENTS

CN 204434580 U 7/2015
DE 815516 C 3/1952
DE 1719930 U 4/1956
DE 1554560 9/1966
DE 1964393 U 7/1967
DE 2228633 A1 1/1974
FR 1337149 A 9/1963

OTHER PUBLICATIONS

Written Opinion of the International Searching Authority dated Jun. 26, 2019 issued in corresponding International Patent Application No. PCT/NL2019/050069 (7 pgs.).

* cited by examiner

POCKET SOAP DISPENSER

CROSS-REFERENCE TO RELATED APPLICATIONS

This application is the U.S. National Phase of PCT/NL2019/050069, filed Feb. 4, 2019, which claims priority to Netherlands Patent Application No. 2020372, filed Feb. 2, 2018, the subject matter of each of which is incorporated herein by reference in its entirety.

FIELD OF THE INVENTION

The present invention relates to a portable, hand-held pocket soap dispenser for dry soap.

BACKGROUND

Soap is used in many applications, including for washing one's hands.

When provided as a solid block, the soap often is exposed to the environment, leaving it prone to loss of quality. Furthermore, a solid block is often used in combination with water, leaving the user with a wet and slippery block of soap which is hard to store. When soap dissolved in water is used in portable soap dispensers, not only does the soap have to be transported but also the water in which the soap is dissolved, resulting in inefficient transport.

DE1554560A discloses a pocket soap dispenser for dispensing soap using a threaded spindle and a nut for driving a piece of soap towards a rotating rasp.

SUMMARY

It is preferred to provide a portable soap dispenser which allows solid soap to be dispensed, with limited exposure of the piece of soap to the environment. Exposure to the environment of the piece of soap may result in loss of a piece of the piece of soap, aging, loss of quality, unintended contact with moisture or dirt, any other negative effect or any combination thereof.

A first aspect provides a portable pocket soap dispenser comprising a soap holder, arranged to engage with a piece of soap; a knife holder, arranged to be rotatably connected with the soap holder, such that the soap holder and the knife holder may rotate relative to each other over an axis of rotation. The knife holder comprises: a knife-blade module, provided substantially radially relative to the axis of rotation, arranged to engage with the piece of soap, such that when the soap holder is rotated relative to the knife holder, the knife-blade module scrapes over the piece of soap. The knife holder further comprises a first opening, provided substantially under the knife-blade module, arranged as an exit for scrapings of the piece of soap.

The soap dispenser preferably encloses at least a substantial part of the piece of soap, herewith protecting the piece of soap from exposure to the environment. The soap dispenser may be temporarily arranged in an open position which allows scrapings of soap to leave the dispenser. After use, the soap dispenser may be placed in a closed position in which the piece of soap is substantially closed off from the environment.

An embodiment of the soap dispenser comprises an urging element arranged to urge the piece of soap towards the knife-blade module.

In another embodiment of the soap dispenser, the soap dispenser is arranged such that the soap holder may be translated relative to the knife holder parallel to the axis of rotation between a first position and a second position, wherein in the first position, the soap piece provided in the soap holder is placed at a distance from the knife-blade module, and in the second position, the piece of soap engages with the knife-blade module.

The soap holder may further comprise one or more exit openings, arranged as an exit for scrapings of the piece of soap, and one or more protrusions arranged to engage with one or more indentations of the piece of soap, such that a rotation of the soap holder is coupled to a rotation of the piece of soap.

A second aspect provides a piece of soap arranged to be provided in a soap holder of a soap dispenser according to any of the previous embodiments, wherein the piece of soap substantially extents from the first radius to the second radius. The piece of soap may comprise one or more indentations, corresponding to the one or more protrusion of the soap holder.

BRIEF DESCRIPTION OF THE DRAWINGS

The various aspects and embodiments thereof will now be discussed in conjunction with drawings. In the drawings.

DETAILED DESCRIPTION OF THE FIGURES

Figure 1:
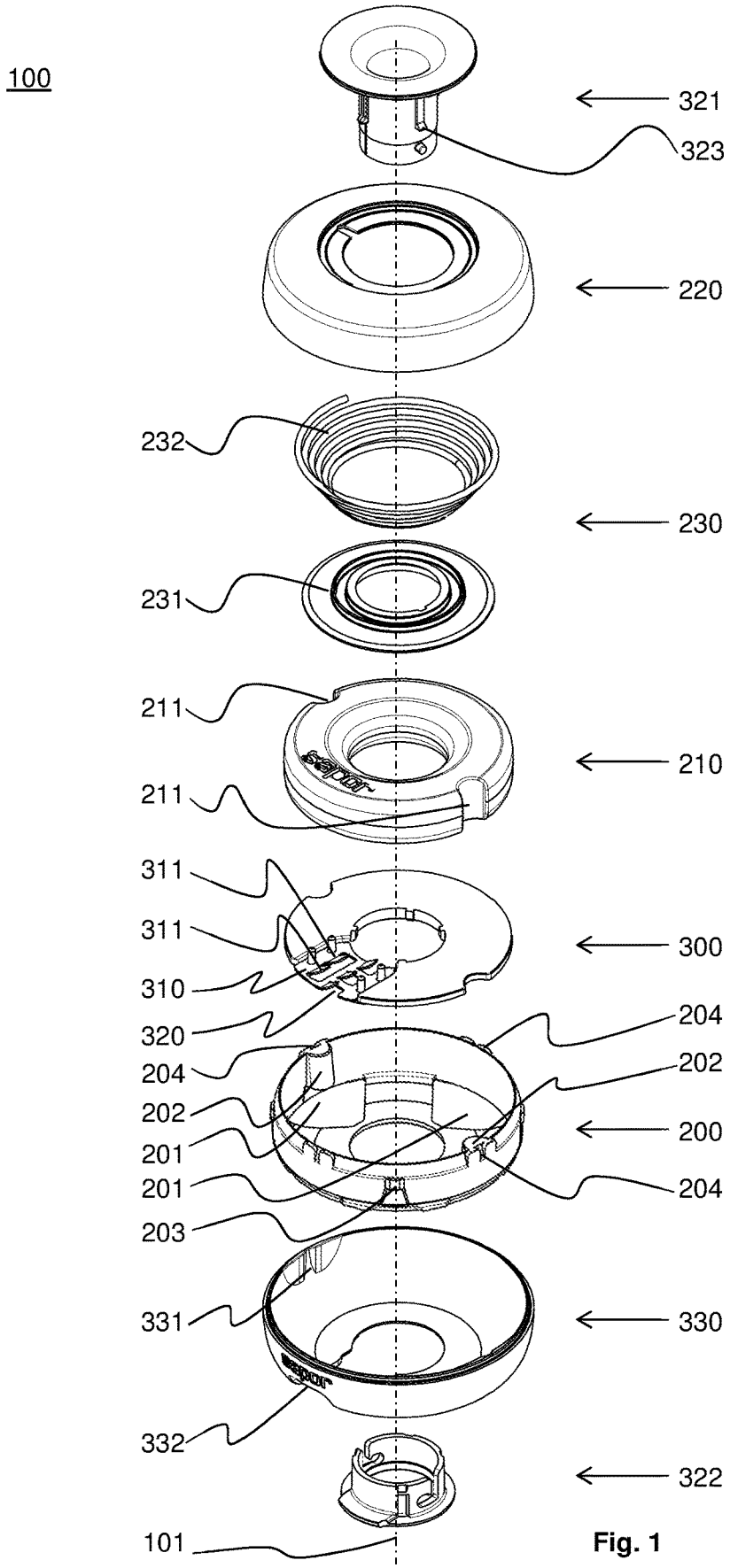
FIG. 1: shows a soap dispenser.

FIG. 1 shows a portable soap dispenser 100, comprising a soap holder 200 and a knife holder 300. The soap holder 200 is arranged to engage with a piece of soap 210. The knife holder 300 is arranged to be rotatably attached to the soap holder 200, such that the knife holder 300 and the soap holder 200 may be rotated relative to each other over an axis of rotation 101.

The knife holder 300 comprises a knife-blade module 310, provided substantially radially relative to the axis of rotation 101, and arranged to engage with the piece of soap 210 provided in the soap holder 200. The knife-blade module 310 is further provided such that when the soap holder 200 rotates relative to the knife holder 300, at least part of the knife-blade module 310 scrapes over the piece of soap 210. The knife holder 300 further comprises a knife holder opening 320, provided substantially under the knife-blade module 310, wherein the knife holder opening 320 is arranged as an exit for scrapings or shavings of soap which are scraped of the piece of soap 210.

The soap holder 200 of the soap dispenser 100 may comprise one or more keying protrusions 202, arranged to correspond to one or more keying indentations 211 comprised by the piece of soap 210. The keying protrusion 202 and corresponding keying indentation 211 may have any shape, and are arranged to couple a rotation of the soap holder 200 around the axis of rotation 101 to a rotation of the piece of soap 210 around the axis of rotation 101. In another embodiment of the soap holder 200, the soap holder 200 comprises one or more keying indentations and the piece of soap 210 comprises one or more corresponding keying protrusions.

In the embodiment of the soap dispenser 100 as shown in FIG. 1, the soap dispenser 100 comprises an urging module 230, wherein the urging module 230 comprises a spring 232 as an urging element and a pressing plate 231. The spring 232 is arranged to at a first side urge the pressing plate 231 towards the piece of soap 210, and therewith urge the piece of soap 210 towards the knife-blade module 310. At a second side of the spring 232, opposite to the first side, the spring 232 is arranged to urge against a top shell 220. The pressing plate 231 is arranged to transfer an urging force of the spring 232 to the piece of soap 210. An embodiment of the soap dispenser 100 without the pressing plate 231 may be envisioned as well, wherein in such an embodiment the urging force of the spring 232 is applied directly to the piece soap 210. The spring 232 may be a coil spring, conical spring, pancake spring, helical spring, Belleville spring, disc spring, any other spring or any combination thereof.

In an embodiment of the urging module 230, a range of translational movement of the urging module 230 over the axis of rotation 101 of the pressing plate 231 is restricted. The restriction prevents the pressing plate 231 from contacting the knife-blades 311, and prevents accidental scraping of the pressing plate 231 when the knife-blades 311 are rotated relative to the pressing plate 231 around the axis of rotation 101. The restriction may be provided by one or more protrusions provided on at least one of the pressing plate 231 and the knife holder 300. Alternatively, the restriction may be provided by one or more restriction protrusions 323 provided by a first clamp 321. When the soap dispenser 100 is assembled, the pressing plate 231 may be provided between the restriction protrusion 323 and the top shell 220.

In an alternative embodiment of the soap dispenser 100 comprising the urging module 230, the soap holder 200 is arranged to be translated relative to the knife holder 300 parallel to the axis of rotation 101 between a first position and a second position. In the first position, the piece of soap 210 provided in the soap holder 200 is provided at a distance from the knife-blade module 310, such that the soap holder 200 may be rotated relative to the knife holder 300 significantly without the knife-blade module 310 scraping scrapings of the piece of soap 210. In the second position, the piece of soap 210 engages with the knife-blade module 310, such that rotation of the soap holder 200 around the axis of rotation 101 relative to the knife holder 300 results in the knife-blade module scraping scrapings of the piece of soap 210.

The knife-blade module 310 of the soap dispenser 100 as shown in FIG. 1 comprises one or more knife-blades 311, wherein edges of the knife-blades 311 are provided substantially radially relative to the axis of rotation 101. The knife-blades 311 comprised by the knife-blade module 310 extend from a first radius from the axis of rotation 101 to a second radius from the axis of rotation 101, wherein the first radius is larger than 0 mm. This arrangement allows one or more knife-blades 311 to substantially engage the piece of soap 120 at any position between the first radius and the second radius. In other words, the extension of the knife-blades 311 from the first radius to the second radius results in no part of any knife-blade 311 being present at the axis of rotation 101. This is preferred because it is not possible to scrape scrapings of the piece of soap 210 at the axis of rotation 101 with a rotating movement around the axis of rotation 101.

In the soap dispenser 100 as shown in FIG. 1, the soap holder 200 comprises one or more soap holder openings 201, arranged as conduits for the scrapings of soap to leave the soap dispenser 100. The soap dispenser 100 further comprises a bottom shell 330 as a closing part, arranged to, in the embodiment of the soap dispenser 100 of FIG. 1, be rotated around the axis of rotation 101 relative to the soap holder 200. The rotation of the bottom shell 330 is coupled to the rotation of the knife holder 300, such that when the bottom shell 330 is rotated, the knife holder 300 rotates with it around the axis of rotation 101.

The coupling between the rotation of the bottom shell 330 and the knife holder 300 is provided by a clamping module comprising the first clamp 321 and a second clamp 322 on which will be elaborated further below. The bottom shell 330 is arranged to be rotated around the axis of rotation 101 through one or more closed positions, and one or more open positions. The bottom shell 330 comprises one or more second openings 332 as exit openings, arranged to, when the bottom shell 330 is in an open position, substantially align with one of the soap holder openings 201 of the soap holder 200, such that a conduit is provided for scrapings of the piece of soap 210 to leave the soap dispenser 100 through one of the second openings 332 and one of the soap holder openings 201.

In an alternative embodiment of the closing part, the closing part is arranged to translate substantially radially relative to the axis of rotation 101 between an open position and a closed position. In the closed position, the closing part substantially blocks one or more of the soap holder openings 201, such that scrapings of soap may not exit the soap dispenser 100. In the open position, the closing part substantially does not block one or more of the soap holder openings 201, such that scraping of soap may exit the soap dispenser 100 through at least one of the one or more soap holder openings 201.

In an embodiment of the soap holder 200, the soap holder 200 comprises one or more soap holder openings 201, for example four openings, wherein the openings may be equiradially provided, for example one opening every 90 degrees, relative to the axis of rotation 101.

In the embodiment of the soap dispenser 100 as shown in FIG. 1, the bottom shell 330 comprises a closing abutment 331, corresponding to one or more closing protrusions 203 comprised by the soap holder 200. When the bottom shell 330 is in the closed position, the closing abutment 331 engages with one of the closing protrusions 203 of the soap holder 200. The engagement results in a force threshold that needs to be exceeded to rotate the bottom shell 330 relative to the soap holder 200, as the closing abutment 331 needs to be disengaged from the one of the closing protrusions 203. A user of the soap dispenser 100 may feel whether the bottom shell 330 is in the open position or in the closed position respectively by the absence or presence of the force threshold. The force threshold may also prevent the bottom shell 330 from rotating to an open position while the soap dispenser 100 is not being used, for example during transport or storage.

The closing abutment 331 may comprise two protrusions, with between the protrusions an indentation arranged to receive at least part of the closing protrusion 203. The closing protrusion 203 may be at least partly chamfered or rounded off to decrease the force threshold. In an alternative embodiment of the soap dispenser 100, the bottom shell 330 comprises one or more closing protrusions, and the soap holder 200 comprises the closing abutment.

The soap dispenser 100 as shown in FIG. 1 further comprises a clamping module comprising a first clamp 321 and a second clamp 322. The first clamp 321 and the second clamp 322 are arranged to engage with one another to be releasably connected. When engaged, the first clamp 321 and the second clamp 322 are arranged to substantially constrain a translation of the soap holder 200 relative to the knife holder 300 over the axis of rotation 101.

The clamping module further comprises a top shell 220 as an enclosing part, arranged to substantially enclose the soap holder 200, piece of soap 210, and knife module 200 together with the bottom shell 330. The top shell 220 is arranged to be rotated relative to the bottom shell 330. The top shell 220 is further arranged as a housing for the urging module 230, and may be arranged to provide grip to a user's hand gripping the top shell 220. The grip may be provided by a particular shape of the top shell 220 or by a high-friction texture.

The top shell 220 as the enclosing part may comprise at the inside one or more coupling protrusions (not shown in FIG. 1), arranged to engage with one or more coupling abutments 204 comprised by the soap holder 200. Herein, the engagement of the coupling protrusions and coupling abutments 204 provides a coupling of the rotation of the top shell 220 around the axis of rotation 101 with the rotation of the soap holder 200 around the axis of rotation 101. Alternatively, the top shell 220 comprises the coupling abutments and the soap holder 200 comprises the coupling protrusions.

The first clamp 321 and the second clamp 322 are arranged such that they extend through the hole provided by the fact that the piece of soap 210, knife module 300, soap holder 200, pressing plate 231 and bottom shell 330 extend from the first radius outwards relative to the axis of rotation 101.

When the user of the soap dispenser 100 wants to place or replace the piece of soap 210 in the soap holder 200, at least part of the clamping module may be disassembled from the soap dispenser 100.

In the embodiment of the soap dispenser 100 as in FIG. 1, all components are aligned around the axis of rotation 101. Further more, all components are provided substantially axisymmetrically around the axis of rotation 101, wherein except for the first clamp 321 and the second clamp 322, the components extend from a certain radius from the axis of rotation 101, wherein said certain radius is larger than 0 mm. The extension of all components except for the first clamp 321 and the second clamp 322 allows the first clamp 321 and the second clamp 322 to be provided at the centre of the soap dispenser 100, resulting in a compact form factor. Furthermore, at a smaller radius relative to the axis of rotation 101, scraping the piece of soap 210 by rotation becomes more difficult. Therefore, the volume within the first radius around the axis of rotation 101 would not have been used for the piece of soap 210 or any other component of the soap dispenser 100.

In an alternative embodiment of the soap dispenser 100, at least part of the first clamp 321 and at least part of the second clamp 322 extend from a third radius, wherein the third radius is larger than 0 and smaller than the first radius. This extending of the first clamp 321 and the second clamp 322 provides a hollow centre of the soap dispenser 100.

The soap dispenser 100 as shown in FIG. 1 is substantially disc shaped and may be sized to fit a user's hand. In alternative embodiments, the soap dispenser 100 is substantially shaped as a cube, rectangular prism, cylinder, triangular prism, any other prism, any other shape or any combination thereof. Embodiments of the piece of soap 210 are envisioned resembling any shape the soap dispenser may have, as to optimally fill the volume of the soap dispenser with soap.

To use the soap dispenser 100, a user may hold the bottom shell 330 as the closing part in one hand, and rotate the top shell 220 as the enclosing part with the other hand. With this rotation, scrapings are scraped of the piece of soap by the knife-blades 311 provided by the knife module 310. The scrapings fall out of the soap dispenser 100 through the knife holder opening 320, at least one of the soap holder openings 201, and the exit opening 332 into the user's hands. Because the rotation of the bottom shell 330 and the knife holder 300 are coupled, the exit opening 332 of the bottom shell 330 and the knife holder opening 320 of the knife holder 300 remain aligned during rotation of the bottom shell 330 relative to the soap holder 200. This means that a substantial part of scrapings of the piece of soap 210 exit the soap dispenser 100 directly after having been scraped, and a building up of soap scrapings in the soap dispenser 100 is prevented. The soap dispenser 100 may be arranged to be used with a single direction of rotation, for example clockwise around the axis of rotation 101, or may be arranged to be used with two directions of rotation, clockwise and counter-clockwise around the axis of rotation 101.

Figure 2:
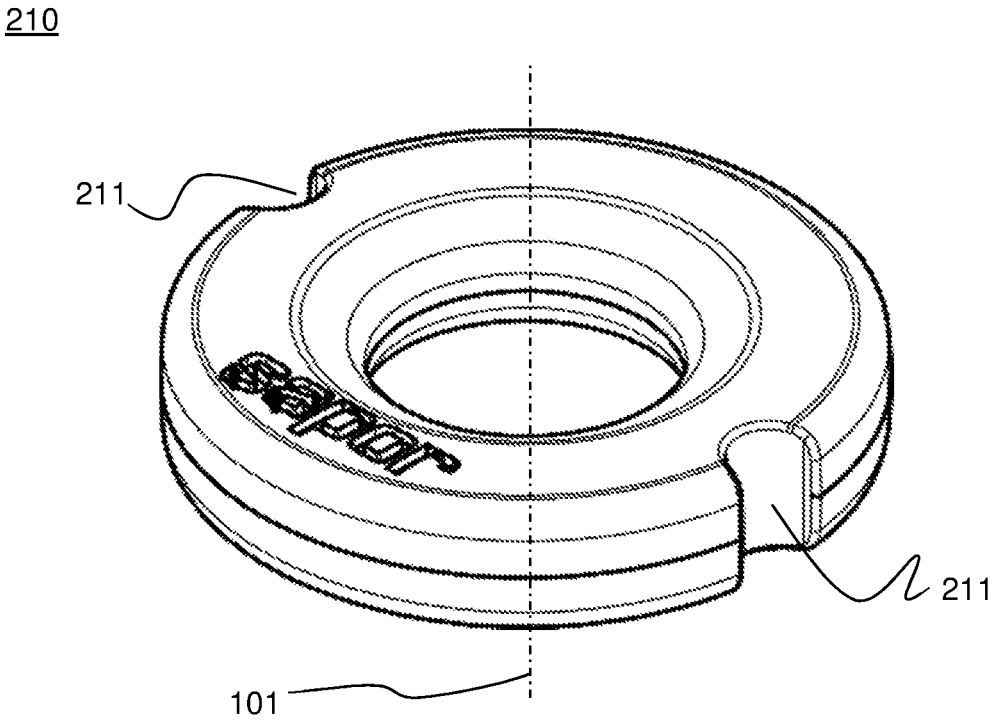
FIG. 2: shows a piece of soap.

FIG. 2 shows a piece of soap 210, arranged to be placed in the soap holder 200 of a soap dispenser 100. In an embodiment of the piece of soap 210, the piece of soap 210 comprises soap with a plurality of colours. A first colour is provided in a bottom part of the piece of soap 210, and a second colour is provided at a top part of the piece of soap 210. The piece of soap 210 is arranged to be placed bottom first in soap holder 200. When the bottom part of the piece of soap 210 is scraped, the scrapings will have the first colour. After the bottom piece has been scraped away, the top part is scraped, resulting in scrapings of the second colour. The second colour may indicate to the user of the soap dispenser 100 that the bottom part is gone and that a new piece of soap 210 may be required soon. The bottom part may be a substantially larger part than the top part. Different colours may also be used to indicate the type, fragrance, any other property, or any combination of properties of the piece of soap 210.

The piece of soap 210 extends substantially from the first radius to the second radius, corresponding to the radial extension of the knife-blades 311 comprised by the knife-blade module 310. The extension from the first radius to the second radius of the piece of soap 210 results in a donut-like shape of the piece of soap. The piece of soap 210 as shown in FIG. 2 comprises the keying indentations 211 substantially at the second radius. In an alternative embodiment of the piece of soap 210, the keying indentations 211 are provided substantially at the first radius.

Pieces of soap 210 and soap holders 200 are envisioned with different corresponding keying indentations 211 and keying protrusions 202 to distinguish between different properties of the soap. Properties may include anti-allergy, anti-bacterial, baby-friendly, biological, sustainable, vegan properties, any other properties or any combination thereof. Only the pieces of soap 210 with the correct keying indentations 211 corresponding to the keying protrusions 202 provided by a certain soap holder can be placed in the soap holder 200 and used in combination with the soap dispenser 100. The different types of pieces of soap 210 and soap holders 200 may be provided with markings to indicate to a user that they are compatible and what properties they hold.

A piece of soap 210 and corresponding soap holder 200 without keying indentations 211 and keying protrusions 202 may also be envisioned. In such an embodiment, a force parallel to the axis of rotation 101 may have to be provided to the piece of soap 210 to prevent the piece of soap 210 from rotating with the knife holder 300 when the bottom shell 330 is rotated relative to the top shell 220 around the axis of rotation 101.

The various aspects and at least some embodiments may be summarised by means of the following numbered embodiments:

In the description above, it will be understood that when an element such as layer, region or substrate is referred to as being "on" or "onto" another element, the element is either directly on the other element, or intervening elements may also be present. Also, it will be understood that the values given in the description above, are given by way of example and that other values may be possible and/or may be strived for.

Furthermore, the invention may also be embodied with less components than provided in the embodiments described here, wherein one component carries out multiple functions. Just as well may the invention be embodied using more elements than depicted in the Figures, wherein functions carried out by one component in the embodiment provided are distributed over multiple components.

It is to be noted that the figures are only schematic representations of embodiments of the invention that are given by way of non-limiting examples. For the purpose of clarity and a concise description, features are described herein as part of the same or separate embodiments, however, it will be appreciated that the scope of the invention may include embodiments having combinations of all or some of the features described. The word 'comprising' does not exclude the presence of other features or steps than those listed in a claim. Furthermore, the words 'a' and 'an' shall not be construed as limited to 'only one', but instead are used to mean 'at least one', and do not exclude a plurality.

A person skilled in the art will readily appreciate that various parameters and values thereof disclosed in the description may be modified and that various embodiments disclosed and/or claimed may be combined without departing from the scope of the invention.

It is stipulated that the reference signs in the claims do not limit the scope of the claims, but are merely inserted to enhance the legibility of the claims.

In summary, to properly clean one's hands, soap may be used in combination with water. However, soap is not always at hand and therefor one might want to carry around soap in a bag or purse. A soap dispenser is provided which allows a user to scrape scrapings of soap of a piece of soap while holding the dispenser in one hand. With the other hand, part of the dispenser may be rotated which causes the scrapings to be scraped of the piece of soap. This process may be performed before wetting the hands, and thus prevent contact between the piece of soap and water. Furthermore, the dispenser substantially encloses the piece of soap and therewith prevents contact between the soap and water, dirt, and other contaminating factors. The dispenser may be closed during transportation to prevent soap ending up in the bag or purse in which the dispenser is carried around.

The invention claimed is:

1. A soap dispenser, comprising:

a soap holder, arranged to engage with a piece of soap;

a knife holder, arranged to be rotatably connected with the soap holder, such that the soap holder and the knife holder may rotate relative to each other over an axis of rotation;

the knife holder comprising a knife-blade module, provided substantially radially relative to the axis of rotation, arranged to engage with the piece of soap, such that when the soap holder is rotated relative to the knife holder, the knife-blade module scrapes over the piece of soap;

one or more soap holder openings, provided substantially under the knife-blade module, arranged as an exit for scrapings of the piece of soap, wherein the one or more soap holder openings are comprised by the soap holder; and a bottom shell part having an inner perimeter substantially similarly shaped as an outer perimeter of a part of the soap holder in which one or more soap holder openings are provided;

wherein the one or more soap holder openings are positioned in between the knife holder and the bottom shell part, wherein:

the bottom shell part is arranged to:

in a closed position, block the one or more soap holder openings; and in an open position, substantially not block the one or more soap holder openings, such that scraping from the piece of soap cannot exit the soap dispenser through one or more soap holder openings, and rotate over the axis of rotation relative to the soap holder between the open position and the closed position.

2. The soap dispenser according to claim 1, wherein the bottom shell part comprises one or more second openings arranged to be aligned with one of the one or more soap holder openings by rotating the bottom shell part relative to the soap holder over the axis of rotation.

3. The soap dispenser according to claim 1, wherein the rotation of the bottom shell part is coupled to the rotation of the knife holder.

4. The soap dispenser according to claim 2, wherein the knife-blade module is aligned with the bottom shell part.

5. The soap dispenser according to claim 1, wherein:

the bottom shell part comprises a first of a closing abutment and a closing protrusion;

the soap holder comprises a second of the closing abutment and the closing protrusion; and the closing protrusion is arranged to engage with the closing abutment when the bottom shell part is in the closed position.

6. The soap dispenser according to claim 1, wherein the soap holder comprises one or more protrusions, arranged to engage with one or more indentations of the piece of soap, such that a rotation of the soap holder is coupled to a rotation of the piece of soap.

7. The soap dispenser according to claim 1, further comprising a clamping module, arranged to clamp the soap holder and the knife holder in a direction parallel to the axis of rotation.

8. The soap dispenser according to claim 7, wherein a rotation of the clamping module around the axis of rotation is coupled to a rotation of the knife holder.

9. The soap dispenser according to claim 7, wherein the clamping module comprises an enclosing part, arranged to substantially enclose the piece of soap, the knife holder and the soap holder together with the bottom shell part.

10. The soap dispenser according to claim 1, the soap holder comprising an urging element arranged to urge the piece of soap towards the knife-blade module.

11. The soap dispenser according to claim 10, wherein the urging element comprises a spring and a pressure plate, wherein the pressure plate is arranged to engage with the piece of soap.

12. The soap dispenser according to claim 1, arranged such that the soap holder may be translated relative to the knife holder parallel to the axis of rotation between a first position and a second position, wherein:

in the first position, the piece of soap is configured to be provided in the soap holder at a distance from the knife-blade module; and in the second position, the piece of soap is configured to engage the knife-blade module.

13. The soap dispenser according to claim 1, wherein:

the knife-blade module extends from a first radius relative to the axis of rotation to a second radius relative to the axis of rotation, wherein the first radius is greater than 0; and the knife-blade module comprises one or more knife-blades, which are arranged to engage with the piece of soap on substantially every radius between the first radius and the second radius.

14. A piece of soap, arranged to be provided in a soap holder of the soap dispenser according to claim 13, wherein the piece of soap substantially extends from the first radius to the second radius and a height of the soap is smaller than the second radius.

15. The piece of soap according to claim 14, comprising:

one or more indentations, corresponding to one or more protrusions of the soap holder, wherein the soap holder comprises an urging element arranged to urge the piece of soap towards the knife-blade module.

16. The piece of soap according to claim 14, wherein the soap is circular and has an opening in a center thereof, the opening having a radius substantially equal to the first radius.

17. A soap dispenser, comprising:

a soap holder, arranged to engage with a piece of soap;

a knife holder, arranged to be rotatably connected with the soap holder, such that the soap holder and the knife holder may rotate relative to each other over an axis of rotation;

the knife holder comprising a knife-blade module, provided substantially radially relative to the axis of rotation, arranged to engage with the piece of soap, such that when the soap holder is rotated relative to the knife holder, the knife-blade module scrapes over the piece of soap;

one or more exit openings, provided substantially under the knife-blade module, arranged as an exit for scrapings of the piece of soap; and a bottom shell part having an inner perimeter substantially similarly shaped as an outer perimeter of a part of the soap holder in which one or more soap holder openings are provided, wherein the one or more soap holder openings are positioned in between the knife holder and the bottom shell part, wherein the soap dispenser further comprises a piece of soap positioned in the soap holder and engaged by the soap holder such that the rotation of the soap holder around the axis of rotation is coupled to the rotation of the piece of soap around the axis of rotation, wherein the bottom shell part is arranged to:

in a closed position, block the one or more soap holder openings; and in an open position, substantially not block the one or more soap holder openings, such that scraping from the piece of soap cannot exit the soap dispenser through the one or more soap holder openings, and rotate over the axis of rotation relative to the soap holder between the open position and the closed position.

* * * * *